United States Patent [19]

Oya

[11] Patent Number: 4,565,018

[45] Date of Patent: Jan. 21, 1986

[54] PLOW FRAME FOR A FRONT-MOUNTED SNOWPLOW

[75] Inventor: Anders Oya, Fiane, Norway

[73] Assignee: Stiansen & Oya A/S, Fiane, Norway

[21] Appl. No.: 692,101

[22] Filed: Jan. 16, 1985

[30] Foreign Application Priority Data

Jan. 19, 1984 [NO] Norway ..... 840199

[51] Int. Cl.[4] ..... E01H 5/06

[52] U.S. Cl. ..... 37/232; 172/821; 172/816; 37/237

[58] Field of Search ..... 37/232, 273, 235, 236; 172/816, 821–825

[56] References Cited

U.S. PATENT DOCUMENTS

| | | | |
|---|---|---|---|
| 1,977,817 | 10/1934 | Bird | 172/816 |
| 2,468,950 | 5/1949 | Wiedman | 37/232 |
| 3,822,751 | 7/1974 | Waterman | 172/821 |
| 4,249,323 | 2/1981 | Mathis | 37/236 |
| 4,254,564 | 3/1981 | Rath | 37/236 |
| 4,281,721 | 8/1981 | Beales | 172/821 |

FOREIGN PATENT DOCUMENTS

| | | | |
|---|---|---|---|
| 137533 | 8/1982 | Japan | 37/103 |

*Primary Examiner*—E. H. Eickholt

*Attorney, Agent, or Firm*—Cushman, Darby & Cushman

[57] ABSTRACT

A plow frame for a front-mounted snowplow, for example, of the type in which the shovel blade can be set in crosswise, diagonal or V-configurations, which via a linkage system with a coupling frame is detachably fastened to a coupling frame on a vehicle. The plow frame has a front part to which the shovel blade is fastened and a rear part to which the linkage system is fastened, said two parts being mutually pivotable about an axis disposed in the direction of movement of the plow. The parts have facing slide plates joined together by a pivot bolt which constitutes said axis of rotation. Each of the slide plates has a pair of opposing projections at the upper and lower sections thereof, respectively, and between said upper and lower projections damper members are provided which preferably are rubber dampers in cylinders.

6 Claims, 1 Drawing Figure

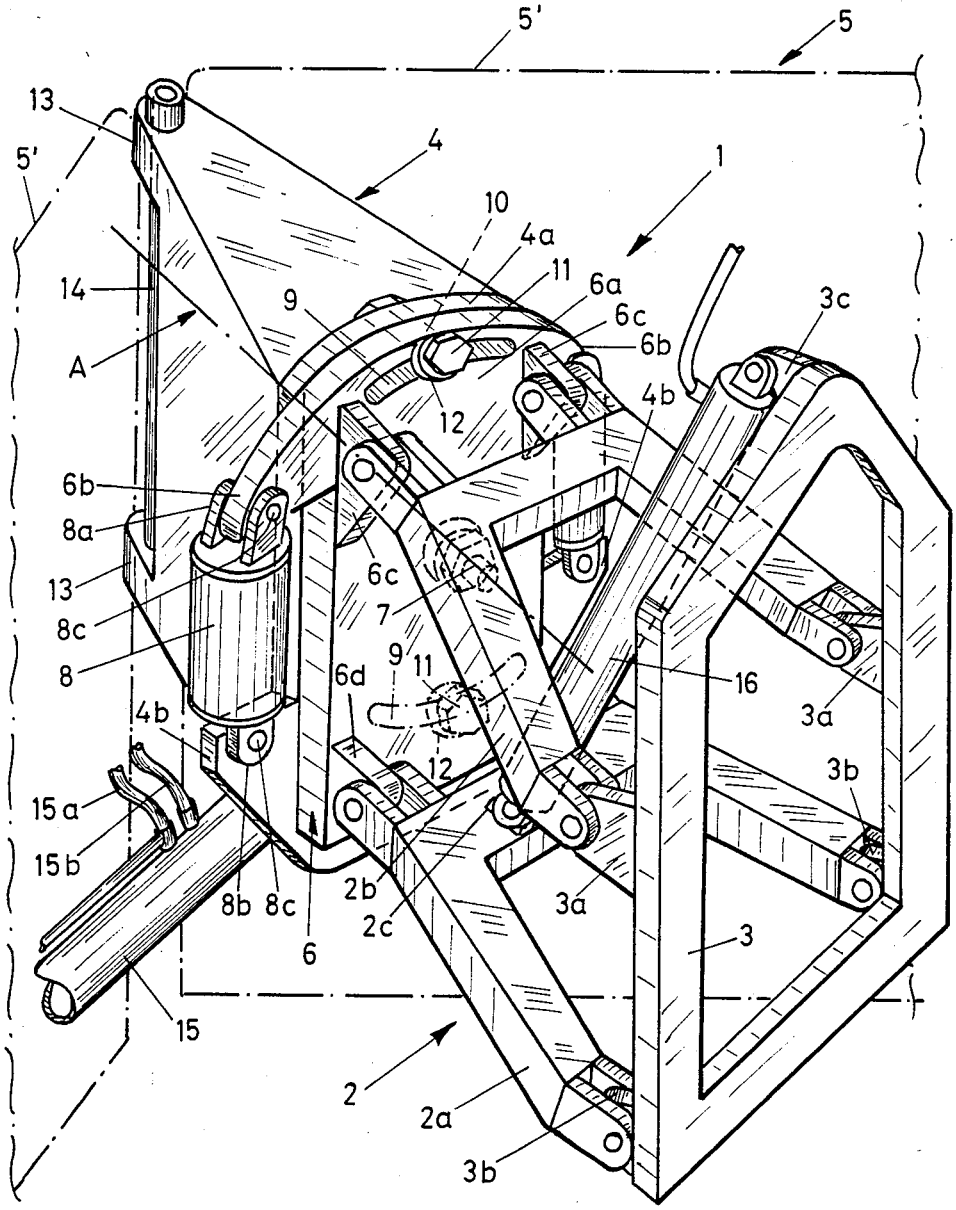
5'
5
13
5'
4
1
10
4a
11
6a
14
9
6c
3c
6b
A
12
4b
6b
8a
13
6c
7
8c
8
9
11
6d
16
3a
4b
12
3b
15a
15b
8b
8c
2b
2c
3a
6
3
15
2
2a
3b

PLOW FRAME FOR A FRONT-MOUNTED SNOWPLOW

The present invention relates to a plow frame for a front-mounted snowplow of the type recited in the preamble of the appurtenant, independent claim 1.

Plow frames are known and in use which permit mutual rotation between the shovel blades and the vehicle about an axis of rotation extending in the direction of movement of the plow, thereby permitting the snowplow at all times to follow any changes in the configuration of the road.

The object of the present invention is to provide a plow frame wherein the two mutually pivotable parts transfer the vehicle's pushing force via surfaces which lie against each other and at the same time are mutually pivotable in opposition to a force exerted by damper members which urge the two frame parts to reassume their starting position in an unloaded state.

This is obtained according to the invention by means of the features recited in the characterizing clause of the appurtenant independent claim 1 and in the following dependent claims.

According to the invention, a plow frame is provided in which the pushing force from the vehicle is distributed over large surfaces between the two mutually pivotable parts of the plow frame, and the mutual rotary movements are damped by damper members which also guide the frame members back to a neutral position when the external loading is suspended. The invention also provides a rotary coupling which is quiet in use and which can be tightened when it begins to show wear, so that there is minimum play between the front and rear parts of the plow frame, which can be a source of noise.

The plow frame can be used with known linkage systems such as for example the parallelogram type, by means of which the plow frame and the snowplow blades can be raised and lowered while retaining their position in space (parallel displacement), or the plow frame can be coupled to a single arm pivotally fastened to the vehicle's coupling frame, which can be raised and lowered in the vertical plane by means of a pressure cylinder controlled from the cab of the vehicle, as is also true in the case of the above-discussed parallelogram linkage system. The single arm is pivotally fastened to the lower section of the rear member of the plow frame, while a brace extends from the arm up to the upper section of said rear member. The brace may be adapted to be adjustable in length for regulating the angle of inclination of the snowplow blade.

To reduce strain on the pivot bolt connecting the front and rear members of the plow frame, as recited in the subsidiary claims, a curved slot is provided in the slide plate of one plow frame member for cooperating with a bolt on the other plow frame member. The head or nut of the bolt rests against the margins of the slot, optionally with an intermediate sliding disk. Any movements between the plow frame's front and rear members which urge the slide plates to separate, for example when lifting the snowplow by means of the linkage system, will thereby be counteracted by said bolt and curved slot, which are disposed at the upper portion of said slide plates.

Fastened to the front member of the plow frame is a vertical shaft on which the snowshovel blade is rotatably mounted. Between the outer portions of the shovel blade and the front member of the plow frame, pressure cylinders are provided for pivoting the shovel from a crosswise position to opposite diagonal positions, so that the shovel can plow straight ahead (disposed crosswise relative to the road), or be set at a diagonal angle toward a side of the road. The shovel may consist of two parts rotatably fastened to each other on the vertical shaft on the front member of the plow frame, such that the two halves of the shovel blade can be pivoted by means of said pressure cylinder into various plowing configurations, such as a forwardly-pointed V, an open-V (in which the two halves of the shovel extend diagonally backwards to meet at a point), aligned crosswise or aligned on a diagonal. The pressure cylinders are operated from the cab of the vehicle.

An embodiment of the invention will be described in the following with reference to the accompanying drawing, which shows the plow frame in perspective view with the dotted lines indicating a twin-blade shovel member, as well as a parallelogram linkage system with a coupling frame for connection to the coupling frame on a vehicle.

The plow frame 1 of the invention, via a parallelogram-type linkage system 2 and a coupling frame 3, is secured to a complementary coupling frame on a vehicle (not shown). The plow frame 1 has a front member 4 to which the shovel blade 5 is fastened, and a rear member 6 to which the linkage system 2 is fastened via upper fastening lugs *6c,6c* and lower fastening lugs *6d,6d*. The two parts 4,6 of the plow frame are mutually rotatable about an axis A extending in the direction of movement for the snowplow. The two members 4,6 exhibit facing slide plates *4a,6a* joined together by a pivot bolt 7, which constitutes said axis of rotation A. Each of the slide plates *4a,6a* has a pair of opposing projections *4b,4b, 6b,6b* at the upper and lower portions thereof, respectively. Provided between each pair of upper and lower projections *4b,6b* are damper members 8 which preferably constitute rubber dampers in cylinders, wherein the mutually movable parts are provided with fastening lugs *8a,8b* with bolt holes for bolts *8c* which pass through corresponding holes in the projections *6b,4b* of the slide plates *4a,6a*.

In one slide plate *6a*, at least one curved slot 9 is provided for cooperating with a guide bolt 10 arranged at the upper portion of the other slide plate *4a*. A bolt head or nut 11, optionally with an intermediate sliding disk 12, rests against the margins of the slot 9, and permits mutual rotation of the slide plates but prevents any separation of the plates when, for example, the plow frame 1 is lifted by means of the linkage system 2. During such a lifting movement, the shovel blade 5 will urge the slide plates *4a,6a* away from each other, but this is effectively counteracted by the guide bolt 10 in the guide slot 9, thereby reducing strain on the pivot bolt 7.

The front member of the plow frame 1, at the forward section thereof, is provided with fastening means 13 for a vertical shaft 14, on which the shovel blade 5 is pivotally mounted by means of known per se bearing sleeves and bearing lugs which are not shown in the drawing.

The front member 4 of the plow frame 1, at two opposing sides thereof, is provided with fastening means for a universal coupling (not shown), with a double-acting pressure cylinder 15,15 whose other ends are connected by a universal coupling (not shown) to the outer portions of each of the shovel blades 5.

The pressure hoses 15*a*,15*b* for the cylinder are connected via rapid couplings to the vehicle's hydraulic system and controlled from the cab of the vehicle.

The shovel blade 5 may consist of two halves 5',5' as shown in the drawing, each pivotally connected to the other by the vertical shaft 14 on the front part 4 of the plow frame 1. By means of said double-acting cylinder 15,15, the two shovel blades 5',5' can be pivoted from the pointed-V position shown in the drawing into a crosswise position, an aligned diagonal position, or into an open-V position, known as the snow collecting position.

The parallelogram-type linkage system comprises two arms 2*a*,2*b* connected on one side to the rear member 6 of the plow frame 1 via lugs 6*c*,6*c* and 6*d*,6*d* and on the other side to the coupling frame 3 by lugs 3*a*,3*a* and 3*b*,3*b*.

Between a lug 3*c* at the upper end of the coupling frame and a lug 2*c* on the lower arm 2*a* of the linkage system 2 near its fastening to the rear member 6 of the plow frame 1, a cylinder 16 is provided for raising and lowering the arms 2*a*,2*b* of the linkage system 2, thereby also moving the plow frame 1 and shovel blades 5. In the drawing, the linkage system and plow are shown in a partially raised position.

The plow frame 1 can also be coupled to the coupling frame 3 by means of a single link arm, for example corresponding to the arm 2*a* in the linkage system 2, with a pressure cylinder 16 arranged in the same way as shown in the drawing for raising and lowering the snowplow 5. In that case, however, a support brace whose length preferably is adjustable must be provided between the upper portion of the rear member 6 of the plow frame 1 and the lower arm 2*a* for holding the plow frame and thereby the shovel blades 5 in the desired position.

Having described my invention, I claim:

1. A plow frame for a front-mounted snowplow, for example of the twin shovel blade type which can be set in crosswise, diagonal or V-configurations, which via a linkage system with a coupling frame is detachably secured to a coupling frame on a vehicle, said plow frame having a front member to which the shovel blade is fastened and a rear member to which the linkage system is fastened, said two members being mutually pivotable about an axis disposed in the direction of movement of the plow, characterized in that the members have facing slide plates joined together by a pivot bolt which constitutes said axis of rotation, and each of the slide plates has a pair of opposing projections at the upper and lower portions thereof, respectively, wherein damper members are provided between said upper and lower projections.

2. A plow frame according to claim 1, characterized in that the damper members are rubber dampers in cylinders.

3. A plow frame according to claim 1, characterized by at least one curved guide slot in one of the slide plates cooperating with a guide bolt in the other slide plate, said guide bolt being in sliding contact with the margins of the slot via the bolt head or nut, an intermediate sliding disk also optionally being provided.

4. A plow frame according to claim 1, characterized in that the front member of the plow frame, at the forward section thereof, has fastening means for a vertical shaft on which the shovel blade is pivotally mounted.

5. A plow frame according to claim 4, characterized in that the front member of the plow frame, on two opposing sides thereof, has fastening means for a universal coupling connected to a double-acting pressure cylinder, and the other ends of the cylinder are connected via a universal coupling to the outer sections of the shovel blade.

6. A plow frame according to claim 5, characterized in that the shovel blade consists of two halves each pivotally connected to the other on the vertical shaft on the front member of the plow frame.

* * * * *